US011227547B2

(12) United States Patent
Wu et al.

(10) Patent No.: US 11,227,547 B2
(45) Date of Patent: Jan. 18, 2022

(54) PIXEL CIRCUIT FOR COMPENSATING THRESHOLD VOLTAGE OF DRIVING TRANSISTOR AND DRIVING METHOD

(71) Applicant: SHENZHEN CHINA STAR OPTOELECTRONICS SEMICONDUCTOR DISPLAY TECHNOLOGY CO., LTD., Shenzhen (CN)

(72) Inventors: Zhen Wu, Shenzhen (CN); Zhenling Wang, Shenzhen (CN)

( * ) Notice: Subject to any disclaimer, the term of this patent is extended or adjusted under 35 U.S.C. 154(b) by 175 days.

(21) Appl. No.: 16/625,769

(22) PCT Filed: Nov. 18, 2019

(86) PCT No.: PCT/CN2019/119061

§ 371 (c)(1),
(2) Date: Dec. 23, 2019

(87) PCT Pub. No.: WO2021/088117

PCT Pub. Date: May 14, 2021

(65) Prior Publication Data

US 2021/0335262 A1 Oct. 28, 2021

(30) Foreign Application Priority Data

Nov. 7, 2019 (CN) ..... 201911080348.5

(51) Int. Cl.

| | |
|---|---|
| ***G09G 3/3258*** | (2016.01) |
| ***G09G 3/3266*** | (2016.01) |
| ***G09G 3/3291*** | (2016.01) |

(52) U.S. Cl.

CPC ..... *G09G 3/3258* (2013.01); *G09G 3/3266* (2013.01); *G09G 3/3291* (2013.01); *G09G 2300/0828* (2013.01); *G09G 2310/0278* (2013.01)

(58) Field of Classification Search

CPC ..... G09G 3/3258
USPC ..... 345/204
See application file for complete search history.

(56) References Cited

U.S. PATENT DOCUMENTS

| | | | | |
|---|---|---|---|---|
| 2006/0244688 | A1 | 11/2006 | Ahn et al. | |
| 2014/0176409 | A1* | 6/2014 | Kim | G09G 3/3233 345/92 |
| 2015/0062137 | A1 | 3/2015 | Yu et al. | |
| 2015/0154908 | A1 | 6/2015 | Nam et al. | |
| 2017/0103702 | A1 | 4/2017 | Bi et al. | |
| 2017/0124947 | A1 | 5/2017 | Kim et al. | |

(Continued)

FOREIGN PATENT DOCUMENTS

| | | | |
|---|---|---|---|
| CN | 1855198 | A | 11/2006 |
| CN | 104700772 | A | 6/2015 |

(Continued)

*Primary Examiner* — Long D Pham

(57) ABSTRACT

The present disclosure provides a pixel circuit, a pixel circuit driving method, and a display device. The display device can sense and store an original threshold voltage of a driving transistor in the turn-on stage by designing a pixel structure and detecting time sequence. An accrual threshold voltage of the driving transistor is read in an next turn-on stage according to a detected result in order to perform an internal compensation in real-time, and in order to sense and store a mobility of the driving transistor. As a result, unevenness of display can be improved.

3 Claims, 6 Drawing Sheets

(56) References Cited

U.S. PATENT DOCUMENTS

| | | | | |
|---|---|---|---|---|
| 2019/0156747 | A1* | 5/2019 | Nie | G09G 3/3266 |
| 2020/0082767 | A1 | 3/2020 | Chen et al. | |

FOREIGN PATENT DOCUMENTS

| | | | | |
|---|---|---|---|---|
| CN | 106782333 | A | | 5/2017 |
| CN | 106847171 | A | | 6/2017 |
| CN | 109545145 | A | | 3/2019 |
| WO | WO 2018/068393 | | * | 4/2018 |

* cited by examiner

PIXEL CIRCUIT FOR COMPENSATING THRESHOLD VOLTAGE OF DRIVING TRANSISTOR AND DRIVING METHOD

FIELD OF INVENTION

The present disclosure relates to the field of display technologies, particularly to a pixel circuit, a pixel circuit driving method, and a display device.

BACKGROUND OF INVENTION

Organic light emitting diode (OLED) display devices utilize self-luminous materials to illuminate driven by electric field which results carrier injection and recombination. The display device has advantages such as self-luminous, wider viewing angles, higher contrast, low power consumption, high response speed, etc. However, due to influence caused from manufacturing processes and characteristic drift, the driving transistors of each pixel have different electrical characteristics. The different electrical characteristics in spatial domain of the driving transistors and the characteristic drift in time domain will cause unevenness display in the OLED display devices.

There are two common compensation methods for compensating threshold voltage drift of the present driving transistors: internal compensation and external compensation. However, the external compensation method can only compensate the electrical characteristics of the driving transistors when of the OLEDs of the display device are turned off. During operation of the display devices, real time compensation for the threshold voltage drift off the driving transistor cannot be performed.

Therefore, a new pixel circuit, a pixel circuit driving thereof, and a display device which can solve the above technical problems are required.

Technical Problems

The present disclosure provides a pixel circuit, a pixel circuit driving method, and a display device for solving technical problems of uneven display due unable to implement threshold voltage drift compensation or of the driving transistor when the display device is turned on.

SUMMARY OF INVENTION

The present disclosure provides following technical solutions for solving the above-mentioned problems.

An embodiment of the present disclosure provides a pixel circuit connected to an external compensation unit.

The external compensation unit is configured to sense and store an original threshold voltage of a driving transistor of the pixel circuit.

An overlapped data signal is obtained by overlapping the original threshold voltage with a display data signal of the pixel circuit, and is input to the pixel circuit. The pixel circuit internally compensates an actual threshold voltage of the driving transistor according to the overlapped data signal of the pixel circuit, and senses and stores a mobility of the driving transistor.

According to the pixel circuit of the embodiment of the present disclosure, the pixel circuit comprises the driving transistor, a first transistor, a second transistor, a third transistor, a fourth transistor, a storing capacitor, and a light-emitting component.

A control end of the driving transistor is connected to a second end of the first transistor and a first end of the third transistor, a first end of the driving transistor is connected to a first end of the second transistor, a second end of the driving transistor is connected to a second end of the third transistor and a first end of the fourth transistor, a control end of the first transistor is connected to a first scan signal, a first end of the first transistor is connected to a data line, a control end of the second transistor is connected to a second scan signal, a second end of the second transistor is connected to a sensing line, a control end of the third transistor is connected to a third scan signal, a control end of the fourth transistor is connected to a fourth scan signal, a second end of the fourth transistor is connected to a first voltage signal, a first end of the storing capacitor is connected to the control end of the driving transistor, a second end of the storing capacitor is connected to the first end of the second transistor, an anode of the light-emitting component is connected to the first end of the driving transistor, a cathode of the light-emitting component is connected to a second voltage signal.

A first end of the sensing line is connected to an initial voltage signal and the external compensation unit, and a second end of the sensing line is connected to the second end of the second transistor.

According to the pixel circuit of the embodiment of the present disclosure, the pixel circuit further comprises a first switch and a second switch. A first end of the first switch is connected to the initial voltage signal, a second end of the first switch is connected to the sensing line, a first end of the second switch is connected to the external compensation unit, and a second end of the second switch is connected to the sensing line.

According to the pixel circuit of the embodiment of the present disclosure, the driving transistor, the first transistor, the second transistor, the third transistor, and the fourth transistor are N-type transistors.

According to the pixel circuit of the embodiment of the present disclosure, the light-emitting component is an organic light-emitting diode.

According to the pixel circuit of the embodiment of the present disclosure, the external compensation unit comprises an analog-to-digital converter, an electric current comparator, a control module, a storage, and a digital-to-analog converter connected in sequence, wherein an input end of the analog-to-digital converter is connected to the sensing line and an output end of the digital-to-analog converter is connected to the first end of the first transistor through the data line.

The embodiment of the present disclosure further provides a display device comprising a pixel circuit connected to an external compensation unit.

The external compensation unit is configured to sense and store an original threshold voltage of a driving transistor of the pixel circuit.

An overlapped data signal is obtained by overlapping the original threshold voltage with a display data signal of the pixel circuit, and is input to the pixel circuit. The pixel circuit internally compensates an actual threshold voltage of the driving transistor according to the overlapped data signal of the pixel circuit, and senses and stores a mobility of the driving transistor.

According to the pixel circuit of the embodiment of the present disclosure, the pixel circuit comprises the driving transistor, a first transistor, a second transistor, a third transistor, a fourth transistor, a storing capacitor, and a light-emitting component.

A control end of the driving transistor is connected to a second end of the first transistor and a first end of the third transistor, a first end of the driving transistor is connected to a first end of the second transistor, a second end of the driving transistor is connected to a second end of the third transistor and a first end of the fourth transistor, a control end of the first transistor is connected to a first scan signal, a first end of the first transistor is connected to a data line, a control end of the second transistor is connected to a second scan signal, a second end of the second transistor is connected to a sensing line, a control end of the third transistor is connected to a third scan signal, a control end of the fourth transistor is connected to a fourth scan signal, a second end of the fourth transistor is connected to a first voltage signal. A first end of the storing capacitor is connected to the control end of the driving transistor, A second end of the storing capacitor is connected to the first end of the second transistor. An anode of the light-emitting component is connected to the first end of the driving transistor, and a cathode of the light-emitting component is connected to a second voltage signal.

A first end of the sensing line is connected to an initial voltage signal and the external compensation unit, and a second end of the sensing line is connected to the second end of the second transistor.

According to the pixel circuit of the embodiment of the present disclosure, a first switch and a second switch, a first end of the first switch is connected to the initial voltage signal, a second end of the first switch is connected to the sensing line, a first end of the second switch is connected to the external compensation unit, and a second end of the second switch is connected to the sensing line.

According to the pixel circuit of the embodiment of the present disclosure, the driving transistor, the first transistor, the second transistor, the third transistor, and the fourth transistor are N-type transistors.

According to the pixel circuit of the embodiment of the present disclosure, the light-emitting component is an organic light-emitting diode.

According to the pixel circuit of the embodiment of the present disclosure, the external compensation unit comprises an analog-to-digital converter, an electric current comparator, a control module, a storage, and a digital-to-analog converter connected in sequence. An input end of the analog-to-digital converter is connected to the sensing line and an output end of the digital-to-analog converter is connected to the first end of the first transistor through the data line.

The embodiment of the present disclosure further provides a pixel circuit driving method comprising:

A step S10: in a turning off stage, an external compensation unit senses and stores an original threshold voltage of a driving transistor.

A step S20: in a turning on stage, obtaining an overlapped data signal by overlapping the original threshold voltage with a display data signal of a pixel circuit, and inputting the overlapped data signal to the pixel circuit. In each frames, the pixel circuit internally compensates an actual threshold voltage of the driving transistor according to the overlapped data signal of the pixel circuit, and senses and stores a mobility of the driving transistor.

According to the pixel circuit of the embodiment of the present disclosure, in the step S20, the pixel circuit internally compensating the actual threshold voltage of the driving transistor further comprises a reset stage, a sensing stage, a voltage writing stage, and an emitting stage.

According to the pixel circuit of the embodiment of the present disclosure, in the reset stage: a first scan signal and a second scan signal provide a high voltage potential, a third scan signal and a fourth scan signal provide a low voltage potential, a sensing line receives an initial voltage signal, a data line receives a reference voltage signal, the driving transistor, a first transistor, and a second transistor are turned on, and a third transistor and a fourth transistor are turned off.

In the sensing stage: the first scan signal and the third scan signal provide the high voltage potential, the second scan signal and the fourth scan signal provide the low voltage potential, the data line receives the reference voltage signal, the driving transistor, the first transistor, and the third transistor are turned on, and the second transistor and the fourth transistor is turned off.

In the voltage writing stage: the first scan signal and the fourth scan signal provide the high voltage potential, the second scan signal and the third scan signal provide the low voltage potential, the data line receives and overlaps the display data signal and the original threshold voltage to obtain the overlapped data signal, the driving transistor, the first transistor, and the fourth transistor are turned on, and the second transistor and the third transistor are turned off.

In the emitting stage: the fourth scan signal provides the high voltage potential, the first scan signal, the second scan signal, and the third scan signal provide the low voltage potential, the data line receives the display data signal, the driving transistor and the fourth transistor are turned on, the first transistor, the second transistor, and the third transistor are turned on, and the driving transistor drives the light-emitting component.

According to the pixel circuit of the embodiment of the present disclosure, in the step S20, sensing and storing the mobility of the driving transistor comprises a first mobility sensing stage, a second mobility sensing stage, and a third mobility sensing stage.

In the first mobility sensing stage: a first scan signal, a second scan signal, and a fourth scan signal provide a high voltage potential, a third scan signal provides a low voltage potential, a data line receives and overlaps the display data signal and the original threshold voltage to obtain the overlapped data signal, a sensing line receives an initial voltage signal, the driving transistor, a first transistor, a second transistor, and a fourth transistor are turned on, and a third transistor is turned off.

In the second mobility sensing stage: the second scan signal and the fourth scan signal provide the high voltage potential, the first scan signal and the third scan signal provide the low voltage potential, the data line receives the reference voltage signal, the driving transistor, the second transistor, and the fourth transistor are turned on, the first transistor and the third transistor are turned off.

In the third mobility sensing stage: the second scan signal and the fourth scan signal provide the high voltage potential, the first scan signal and the third scan signal provide the low voltage potential, the data line receives the initial voltage signal, the external compensation unit is connected to the sensing line, the driving transistor, the second transistor, and the fourth transistor are turned on, and the first transistor and the third transistor are turned off.

According to the pixel circuit of the embodiment of the present disclosure, in the step S10, the external compensation unit sensing and storing the original threshold voltage of the driving transistor comprises a first original threshold voltage sensing stage, a second original threshold voltage sensing stage, and a third original threshold voltage sensing stage.

In the first original threshold voltage sensing stage: a second scan signal and a fourth scan signal provide a high voltage potential, a third scan signal provides a low voltage potential, a data line receives the display data signal, a sensing line receives an initial voltage signal, the driving transistor, a first transistor, a second transistor, and a fourth transistor are turned on, and a third transistor is turned off.

In the second original threshold voltage sensing stage: the second scan signal and the fourth scan signal provide the high voltage potential, the first scan signal and the third scan signal provide the low voltage potential, the data line receives the display data signal, the driving transistor, the second transistor, and the fourth transistor are turned on, and the first transistor and the third transistor are turned off.

In the second original threshold voltage sensing stage: the second scan signal and the fourth scan signal provide the high voltage potential, the first scan signal and the third scan signal provide the low voltage potential, the data line receives the display data signal, the external compensation unit is connected to the sensing line, the driving transistor, the second transistor, and the fourth transistor are turned on, and the first transistor and the third transistor are turned off.

Beneficial Effect

The beneficial effect is: the pixel circuit, the pixel circuit driving method, and the display device provides by the embodiments of the present disclosure can sense and store the original threshold voltage of the driving transistor in the turn-on stage by designing a pixel structure and detecting time sequence. The accrual threshold voltage of the driving transistor is read in the next turn-on stage according to the detected result in order to perform internal compensation in real-time, and in order to sense and store the mobility of the driving transistor. As a result, unevenness of display can be improved.

DESCRIPTION OF DRAWINGS

In order to clarify embodiments or technical solutions of the present technologies, the required drawings of the embodiments or the technical solutions will be briefly described below. Obviously, the drawings in the following description are merely parts of embodiments. Additional drawings may be obtained by a skilled person in the art without creative effort according to the following drawings.

DETAILED DESCRIPTION OF PREFERRED EMBODIMENTS

Figure 1:
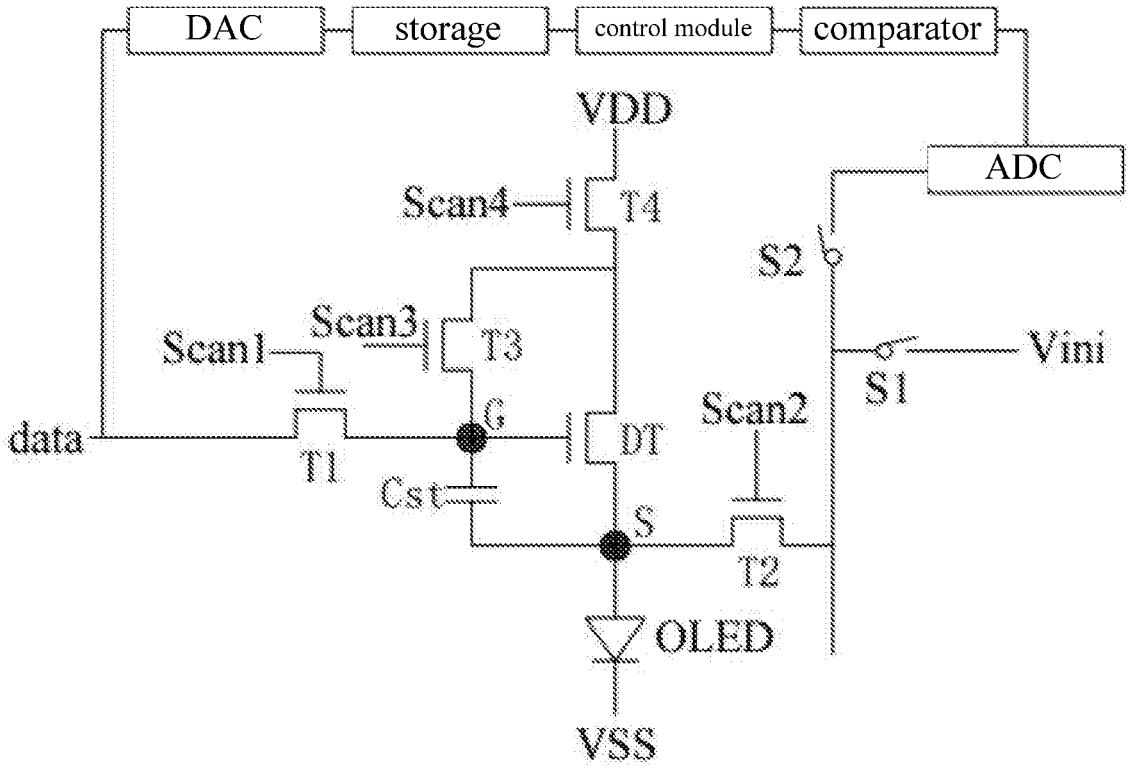
FIG. 1 illustrates a structural diagram of a pixel circuit of the embodiment of the present disclosure.

The following description of the various embodiments is provided with reference of drawings to illustrate specific embodiments. Directional terms mentioned in the present disclosure, such as upper, lower, front, back, left, right, inside, outside, lateral, etc., are only referring to the direction of the drawing. Therefore, the directional terms used to describe and clarify the present disclosure should not be viewed as limitations of the present disclosure. In the drawing, structurally similar elements are denoted by the same reference numbers.

The present disclosure solves drawbacks of present pixel circuits, present pixel circuit driving methods, and present display devices which cannot perform threshold voltage drift compensation or of the driving transistor when the display devices are turned on.

As shown in FIG. 1, a circuit provided by an embodiment of the present disclosure is connected to an external compensation unit. The external compensation unit is configured to sense and store an original threshold voltage Vth0 of the driving transistor DT of the pixel circuit. An overlapped data signal is obtained by summing up the original threshold voltage Vth0 and a display data signal Vdata of the pixel circuit. The overlapped data signal is input to the pixel circuit. The pixel circuit internally compensates an actual threshold voltage Vth of the driving transistor DT according to the overlapped data signal, and detects and stores a mobility of the driving transistor DT.

More particular, the pixel circuit includes the driving transistor DT, a first transistor T1, a second transistor T2, a third transistor T3, a fourth transistor T4, a storing capacitor Cst, and an light-emitting component. A control end of the driving transistor DT is connected to a second end of the first transistor T1 and a first end of the third transistor T3. A first end of the driving transistor DT is connected to a first end of the second transistor T2. A second end of the driving transistor DT is connected to a second end of the third transistor T3 and a first end of the fourth transistor T4. A control end of the first transistor T1 is connected to a first scan signal S1. A first end of the first transistor T1 is connected to a data line. A control end of the second transistor T2 is connected to a second scan signal S2. A second end of the second transistor T2 is connected to a sensing line. A control end of the third transistor T3 is connected to a third scan signal S3. A control end of the fourth transistor T4 is connected to a fourth scan signal S4. A second end of the fourth transistor T4 is connected to a first voltage signal VDD. A first end of the storing capacitor Cst is connected to the control end of the driving transistor DT. A second end of the storing capacitor Cst is connected to the first end of the second transistor T2. An anode of the light-emitting component is connected to the first end of the driving transistor DT. A cathode of the light-emitting component is connected to a second voltage signal VSS. A first end of the sensing line is connected to an initial voltage signal Vini and the external compensation unit. A second end of the sensing line is connected to the second end of the second transistor T2.

It should be noted that the control end, the first end, and the second end of the embodiment of the present disclosure are gate, source and drain respectively. The first end and the second end can be exchanged. A first node G is at the control end of the driving transistor DT. A second node S is at the first end of the driving transistor DT.

In the embodiment of the present disclosure, the light-emitting component is an organic light-emitting diode.

Selectively, the pixel circuit further includes a first switch S1 and a second switch S2. A first end of the first switch S1 is connected to the initial voltage signal Vini. A second end of the first switch S1 is connected to the sensing line. A first end of the second switch S2 is connected to the external compensation unit. A second end of the second switch is connected to the sensing line. The pixel circuit is controlled to be connected to the initial voltage signal Vini or the external compensation unit through the on and off of the first switch and the second switch.

Selectively, the external compensation unit includes an analog-to-digital converter, an electric current comparator, a control module, a storage, and a digital-to-analog converter connected in sequence. An input end of the analog-to-digital converter is connected to the sensing line. An output end of the digital-to-analog converter is connected to the first end of the first transistor T1 through the data line. The analog-to-digital converter is utilized to convert an analog signal of the sensing line into a digital signal. The storage is utilized to store compensation data. The digital-to-analog converter is utilized to convert the compensation data an analog compensation signal and is utilized to compensate the analog compensation signal into the data line.

More particularly, the driving transistor DT, the first transistor T1, the second transistor T2, the third transistor T3, and the fourth transistor T4 are N-type thin film transistors.

More particularly, the first scan signal S1, the second scan signal S2, the third scan signal S3, and the fourth scan signal S4 are all provided by an external timing controller.

Figure 2:
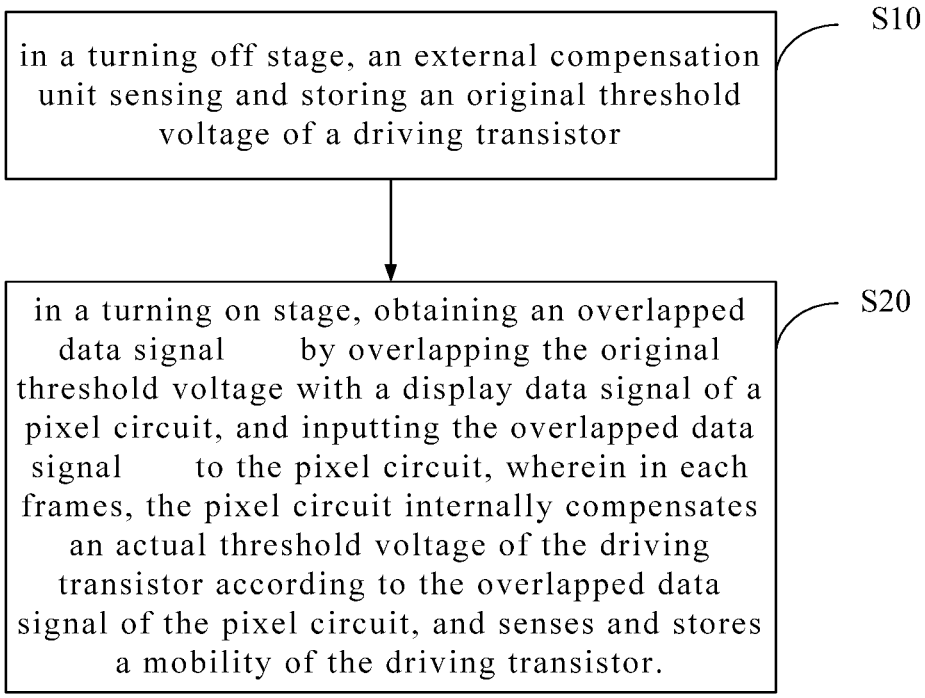
FIG. 2 illustrates a flow chart of a pixel circuit driving method of the embodiment of the present disclosure.
Figure 3:
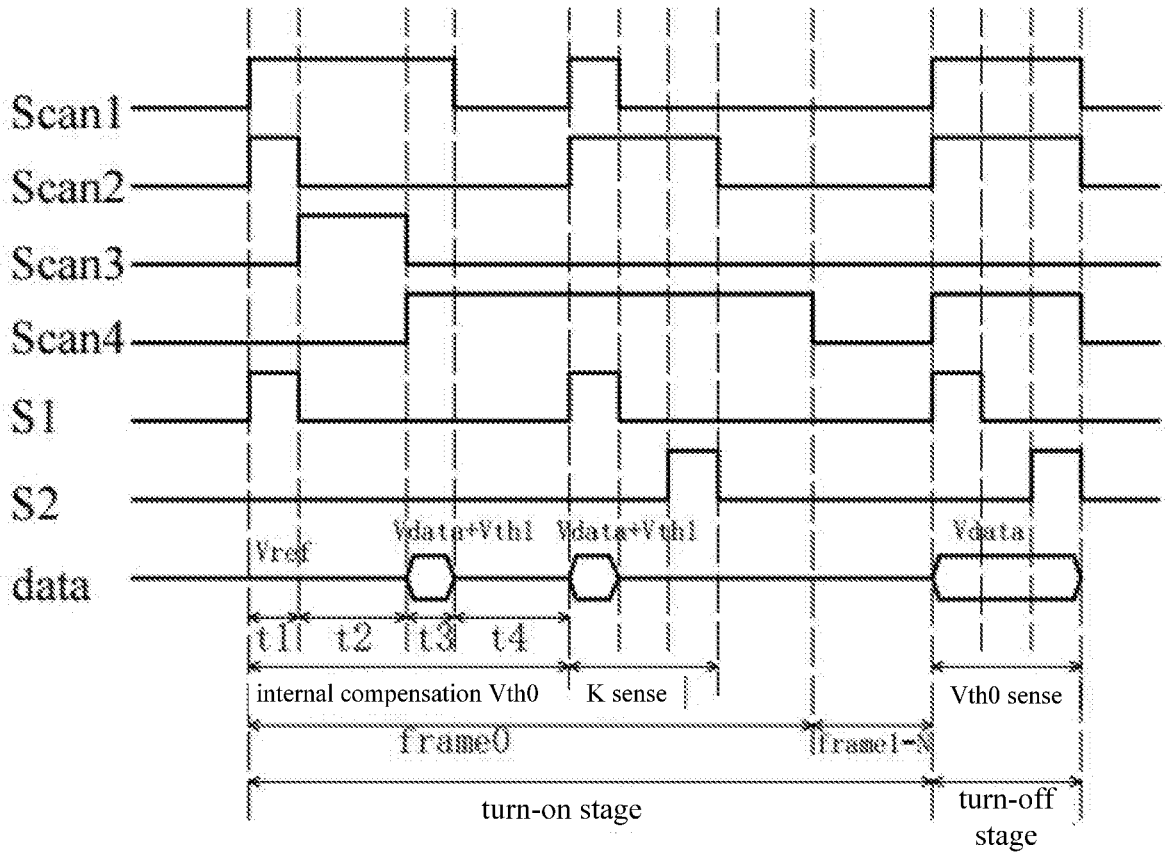
FIG. 3 illustrates a time sequence diagram of the pixel circuit of the embodiment of the present disclosure.

As shown in FIG. 2 and FIG. 3, a pixel circuit driving method of the embodiment of the present disclosure applies the pixel circuit described above. It can be understood that the display device adopting the pixel circuit includes cycle durations formed plural turn-on stages and turn-off stages. The pixel circuit driving method includes the following steps.

Step S10: in a turning off stage, the external compensation unit senses and stores the original threshold voltage Vth0 of a driving transistor DT.

Step S20: in a turning on stage, the overlapped data signal is obtained by overlapping the original threshold voltage Vth0 with the display data signal Vdata of a pixel circuit, and the overlapped data signal is input to the pixel circuit. In each frames, the pixel circuit internally compensates the actual threshold voltage Vth of the driving transistor DT according to the overlapped data signal of the pixel circuit, and senses and stores the mobility K of the driving transistor DT.

More particularly, in the step S20, the pixel circuit internally compensating the actual threshold voltage Vth of the driving transistor DT further includes a reset stage, a sensing stage, a voltage writing stage, and an emitting stage.

Figure 4A:
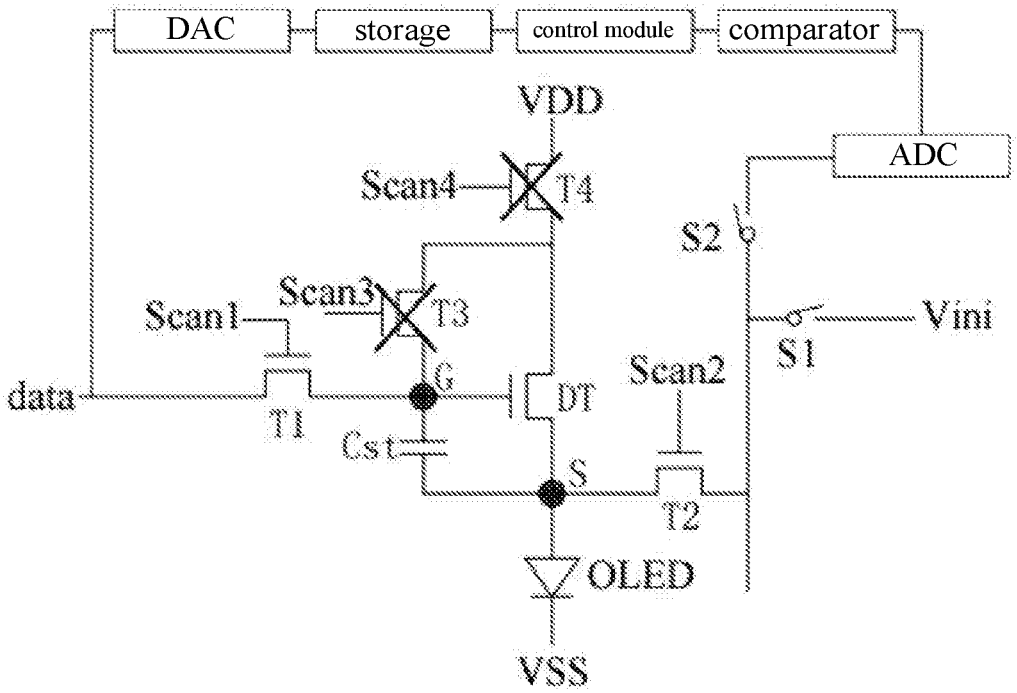
FIG. 4A illustrates the structural diagram of a pixel circuit in a reset stage of the embodiment of the present disclosure.

In the reset stage: please refer to FIG. 3 and FIG. 4A, in a duration t1, the first scan signal S1 and the second scan signal S2 provide a high voltage potential. The third scan signal S3 and the fourth scan signal S4 provide a low voltage potential. The first switch S2 is closed. The second switch S2 is opened. The sensing line receives the initial voltage signal Vini. The data line receives a reference voltage signal Vref. The driving transistor DT, the first transistor T1, and the second transistor T2 are turned on. The third transistor T3 and the fourth transistor T4 are turned off. The first node G receives the reference voltage signal Vref. The second node S receive the initial voltage signal Vini.

Figure 4B:
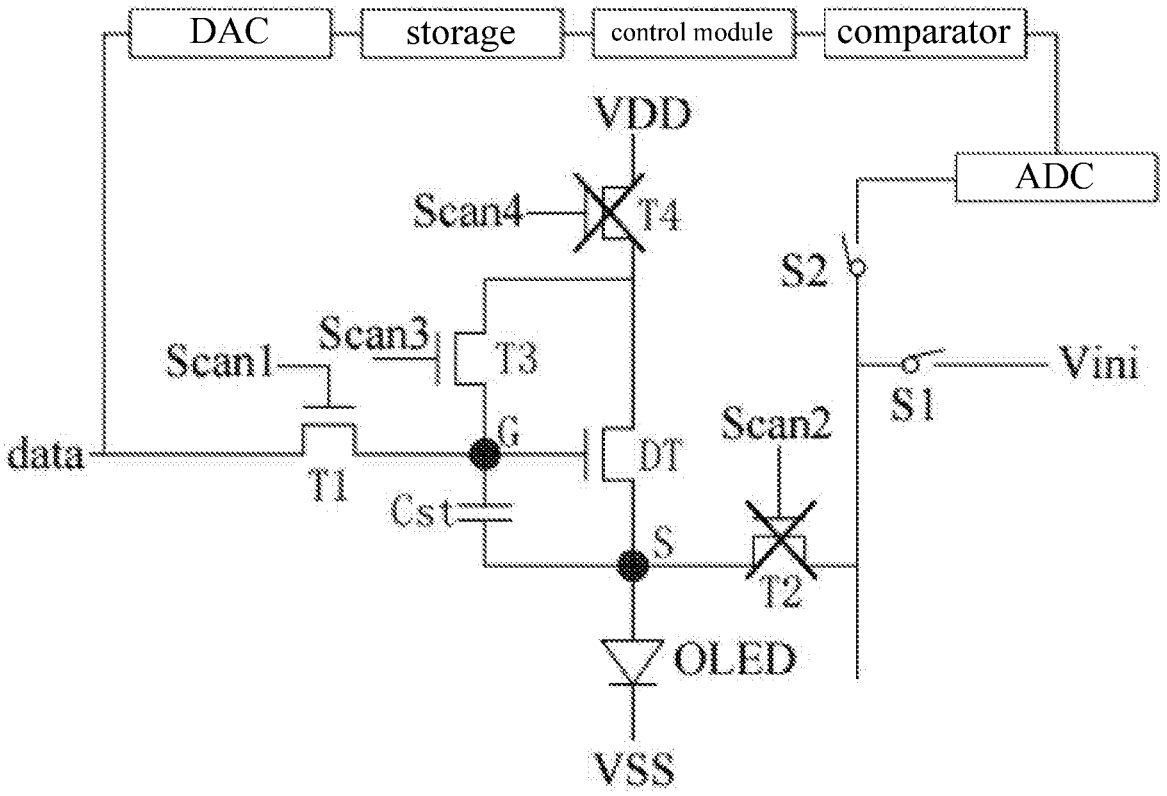
FIG. 4B illustrates the structural diagram of a pixel circuit in a sensing stage of the embodiment of the present disclosure.

In the sensing stage: please refer to FIG. 3 and FIG. 4B, in a duration t2, the first scan signal S1 and the third scan signal S3 provide the high voltage potential. The second scan signal S2 and the fourth scan signal S4 provide the low voltage potential. The data line receives the reference voltage signal Vref. The driving transistor DT, the first transistor T1, and the third transistor T3 are turned on. The second transistor T2 and the fourth transistor T4 are turned off. The first node G receives the reference voltage signal Vref. The storage capacitor Cst discharges through the fourth transistor. A voltage potential of the second node S is raised. A voltage of the second node changes to Vref-Vth. Vth is the actual threshold voltage of the driving transistor DT in the turn-on stage.

Figure 4C:
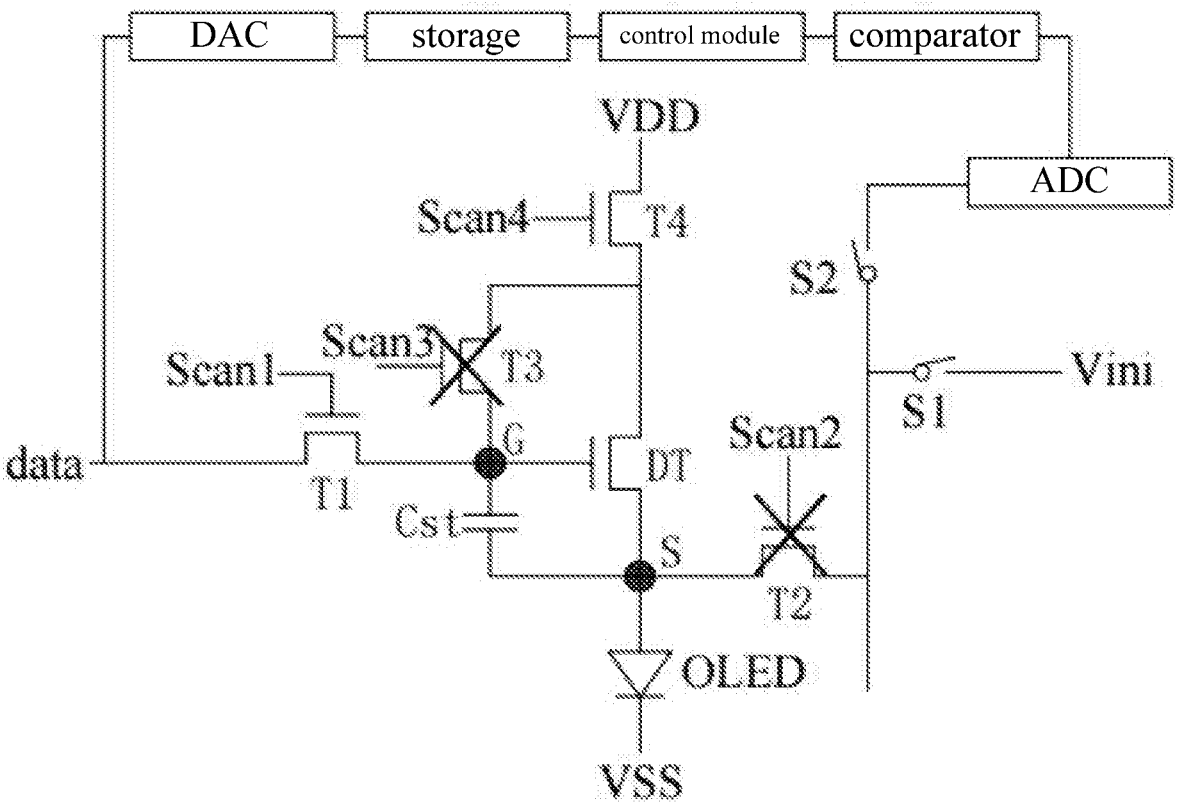
FIG. 4C illustrates the structural diagram of a pixel circuit in a voltage writing stage of the embodiment of the present disclosure.

In the voltage writing stage: please refer to FIG. 3 and FIG. 4C, in a duration t3, the first scan signal S1 and the fourth scan signal S4 provide the high voltage potential. The second scan signal S2 and the third scan signal S3 provide the low voltage potential. The data line receives and overlaps the display data signal Vdata and the original threshold voltage Vth0 to obtain the overlapped data signal. The driving transistor DT or, the first transistor T1, and the fourth transistor T4 are turned on. The second transistor T2 and the third transistor T3 is turned off. The first node G receives Vdata+Vth. The voltage of the second node S remains the same, i.e. Vref−Vth. A voltage between the data and the source of the driving transistor DT is a voltage difference between the first node G and the second node S, i.e. Vga=Vdata−Vref+Vth+Vth0. Vth0 is the original threshold voltage Vth0 of the driving transistor DT detected in turn-off stage.

More particularly, the high voltage potential of the reference voltage signal Vref is lower than the high voltage potential of the display data signal Vdata.

Figure 4D:
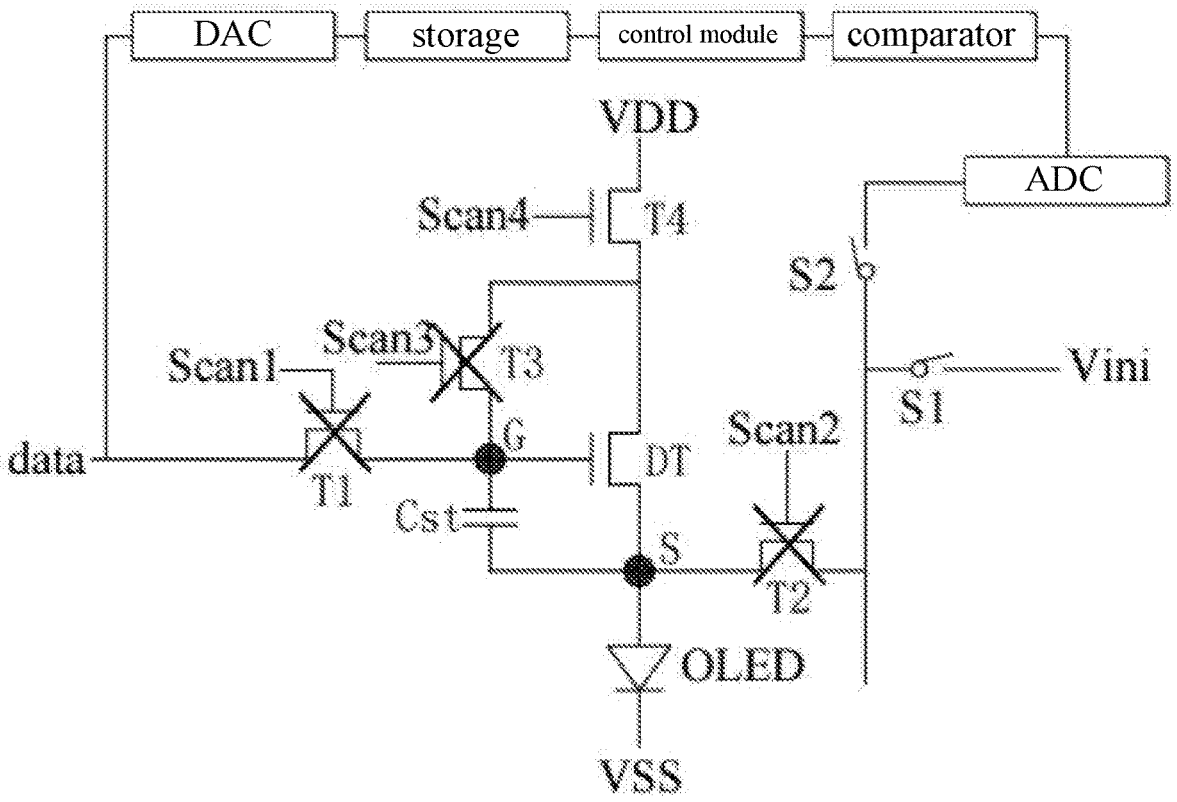
FIG. 4D illustrates the structural diagram of a pixel circuit in an emitting stage of the embodiment of the present disclosure.

In the emitting stage: please refer to FIG. 3 and FIG. 4D, in a duration t4, the fourth scan signal S4 provides the high voltage potential. The first scan signal S1, the second scan signal S2, and the third scan signal S3 provide the low voltage potential. The data line receives the display data signal Vdata. The driving transistor DT and the fourth transistor T4 are turned on. The first transistor T1, the second transistor T2, and the third transistor T2 are turned on. The driving transistor DT drives the light-emitting component to illuminate.

A formula to calculate an electric current flowing though the light-emitting component is IOLED=k(Vgs−Vth)^2=k(Vdata−Vref+Vth0)^2.

Therefore, the electric current flowing though the light-emitting component is regardless to the actual threshold voltage Vth of the driving transistor DT in the turn-on stage. As a result, variation of the threshold voltage of the driving transistor DT can be efficiently compensated in real-time. The luminous evenness of the light-emitting component is ensured due to quicker compensating speed of internal compensation so that the display effect of images is improved.

More particularly, in the step S20, sensing and storing the mobility K of the driving transistor DT includes a first k value sensing stage, a second k value sensing stage, and a third k value sensing stage.

In the first k value sensing stage: the first scan signal S1, the second scan signal S2, and the fourth scan signal S4 provide the high voltage potential. The third scan signal S3 provides the low voltage potential. The data line receives and overlaps the display data signal Vdata and the original threshold voltage Vth0 to obtain the overlapped data signal. The first switch S1 is closed. The second switch is opened.

The sensing line receives an initial voltage signal Vini. The driving transistor DT, the first transistor T1, the second transistor T2, and the fourth transistor T4 are turned on. The third transistor T3 is turned off. The first node G receives a voltage potential Vdata+Vth0. The second node S receives the initial voltage signal Vini.

In the second k value sensing stage: the second scan signal S2 and the fourth scan signal S4 provide the high voltage potential. The first scan signal S1 and the third scan signal S3 provides the low voltage potential. The data line receives the reference voltage signal Vref. The driving transistor DT, the second transistor T2, and the fourth transistor T4 are turned on. The first transistor T1 and the third transistor T3 are turned off.

In the first k value sensing stage: the second scan signal S2 and the fourth scan signal S4 provide the high voltage potential. The first scan signal S1 and the third scan signal S3 provide the low voltage potential. The data line receives the initial voltage signal Vini. The first switch S2 is opened. The second switch S2 is closed. The external compensation unit is connected to the sensing line. The driving transistor DT, the second transistor T2, and the fourth transistor T4 are turned on. The first transistor T1 and the third transistor T3 are turned off. The external control unit can obtain the charging voltage of the sensing line, and obtain and store the mobility K according to the charging voltage.

More particularly, in the step S10, the external compensation unit senses and stores the original threshold voltage Vth0 of the driving transistor DT includes a first original threshold voltage Vth0 sensing stage, a second original threshold voltage Vth0 sensing stage, and a third original threshold voltage Vth0 sensing stage.

In the first original threshold voltage Vth0 sensing stage: the second scan signal S2 and the fourth scan signal S4 provide the high voltage potential. The third scan signal S3 provides the low voltage potential. The data line receives the display data signal Vdata. The sensing line receives an initial voltage signal Vini. The driving transistor DT, the first transistor T1, the second transistor T2, and the fourth transistor T4 are turned on. The third transistor T3 is turned off.

In the second original threshold voltage Vth0 sensing stage: the second scan signal S2 and the fourth scan signal S4 provide the high voltage potential. The first scan signal S1 and the third scan signal S3 provide the low voltage potential. The data line receives the display data signal Vdata. The driving transistor DT, the second transistor T2, and the fourth transistor T4 are turned on. The first transistor T1 and the third transistor T3 are turned off.

In the second original threshold voltage Vth0 sensing stage: the second scan signal S2 and the fourth scan signal S4 provide the high voltage potential. The first scan signal S1 and the third scan signal S3 provide the low voltage potential. The data line receives the display data signal Vdata. The external compensation unit is connected to the sensing line. The driving transistor DT, the second transistor T2, and the fourth transistor T4 are turned on. The first transistor T1 and the third transistor T3 are turned off. The original threshold voltage Vth0 is stored to the storage of the external compensation unit.

The embodiment of the present disclosure embodiment also provides a display device. The display device includes the pixel circuit described above. The display device may be any product or component having a display function, such as a mobile phone, a tablet computer, a television, a display, a notebook computer, a digital photo frame, and a navigator.

The beneficial effects is: the pixel circuit, the pixel circuit driving method, and the display device provides by the embodiments of the present disclosure can sense and store the original threshold voltage of the driving transistor in the turn-on stage by designing a pixel structure and detecting time sequence. The accrual threshold voltage of the driving transistor is read in the next turn-on stage according to the detected result in order to perform internal compensation in real-time, and in order to sense and store the mobility of the driving transistor. As a result, unevenness of display can be improved.

To conclude, although the present disclosure has been disclosed by above-mentioned preferred embodiments, the above-mentioned preferred embodiments are not limitations to the present disclosure. Variations and modifications can be obtained by a person skilled in the art without departing from the aspect and scope of the present disclosure. Therefore, the protected scope of the present disclosure is subject to the defined scope of claims.

What is claimed is:

1. A pixel circuit driving method comprising following steps:

a step S10: in a turning off stage, an external compensation unit sensing and storing an original threshold voltage of a driving transistor; and a step S20: in a turning on stage, obtaining an overlapped data signal by overlapping the original threshold voltage with a display data signal of a pixel circuit, and inputting the overlapped data signal to the pixel circuit, wherein in each frames, the pixel circuit internally compensates an actual threshold voltage of the driving transistor according to the overlapped data signal of the pixel circuit, and senses and stores a mobility of the driving transistor;

wherein in the step S20, the pixel circuit internally compensating the actual threshold voltage of the driving transistor further comprises a reset stage, a sensing stage, a voltage writing stage, and an emitting stage;

wherein in the reset stage: a first scan signal and a second scan signal provide a high voltage potential, a third scan signal and a fourth scan signal provide a low voltage potential, a sensing line receives an initial voltage signal, a data line receives a reference voltage signal, the driving transistor, a first transistor, and a second transistor are turned on, and a third transistor and a fourth transistor are turned off;

in the sensing stage: the first scan signal and the third scan signal provide the high voltage potential, the second scan signal and the fourth scan signal provide the low voltage potential, the data line receives the reference voltage signal, the driving transistor, the first transistor, and the third transistor are turned on, and the second transistor and the fourth transistor is turned off;

in the voltage writing stage: the first scan signal and the fourth scan signal provide the high voltage potential, the second scan signal and the third scan signal provide the low voltage potential, the data line receives and overlaps the display data signal and the original threshold voltage to obtain the overlapped data signal, the driving transistor, the first transistor, and the fourth transistor are turned on, and the second transistor and the third transistor are turned off; and in the emitting stage: the fourth scan signal provides the high voltage potential, the first scan signal, the second scan signal, and the third scan signal provide the low voltage potential, the data line receives the display data signal, the driving transistor and the fourth transistor are turned on, the first transistor, the second transistor, and the third transistor are turned on, and the driving transistor drives the light-emitting component.

2. The pixel circuit driving method according to claim 1, wherein in the step S20, sensing and storing the mobility of the driving transistor comprises a first mobility sensing stage, a second mobility sensing stage, and a third mobility sensing stage, wherein in the first mobility sensing stage: a first scan signal, a second scan signal, and a fourth scan signal provide a high voltage potential, a third scan signal provides a low voltage potential, a data line receives and overlaps the display data signal and the original threshold voltage to obtain the overlapped data signal, a sensing line receives an initial voltage signal, the driving transistor, a first transistor, a second transistor, and a fourth transistor are turned on, and a third transistor is turned off;

in the second mobility sensing stage: the second scan signal and the fourth scan signal provide the high voltage potential, the first scan signal and the third scan signal provide the low voltage potential, the data line receives the reference voltage signal, the driving transistor, the second transistor, and the fourth transistor are turned on, the first transistor and the third transistor are turned off;

in the third mobility sensing stage: the second scan signal and the fourth scan signal provide the high voltage potential, the first scan signal and the third scan signal provide the low voltage potential, the data line receives the initial voltage signal, the external compensation unit is connected to the sensing line, the driving transistor, the second transistor, and the fourth transistor are turned on, and the first transistor and the third transistor are turned off.

3. The pixel circuit driving method according to claim 1, wherein in the step S10, the external compensation unit sensing and storing the original threshold voltage of the driving transistor comprises a first original threshold voltage sensing stage, a second original threshold voltage sensing stage, and a third original threshold voltage sensing stage, wherein in the first original threshold voltage sensing stage: a second scan signal and a fourth scan signal provide a high voltage potential, a third scan signal provides a low voltage potential, a data line receives the display data signal, a sensing line receives an initial voltage signal, the driving transistor, a first transistor, a second transistor, and a fourth transistor are turned on, and a third transistor is turned off;

in the second original threshold voltage sensing stage: the second scan signal and the fourth scan signal provide the high voltage potential, the first scan signal and the third scan signal provide the low voltage potential, the data line receives the display data signal, the driving transistor, the second transistor, and the fourth transistor are turned on, and the first transistor and the third transistor are turned off;

in the second original threshold voltage sensing stage: the second scan signal and the fourth scan signal provide the high voltage potential, the first scan signal and the third scan signal provide the low voltage potential, the data line receives the display data signal, the external compensation unit is connected to the sensing line, the driving transistor, the second transistor, and the fourth transistor are turned on, and the first transistor and the third transistor are turned off.

* * * * *